US011306541B2

(12) United States Patent
Clesen et al.

(10) Patent No.: US 11,306,541 B2
(45) Date of Patent: Apr. 19, 2022

(54) DRILL BIT

(71) Applicant: TMT TAPPING-MEASURING-TECHNOLOGY SARL, Luxembourg (LU)

(72) Inventors: Romain Clesen, Colpach Haut (LU); Gerhard Meier, Trier (DE)

(73) Assignee: TMT TAPPING-MEASURING-TECHNOLOGY SARL, Luxembourg (LU)

( * ) Notice: Subject to any disclaimer, the term of this patent is extended or adjusted under 35 U.S.C. 154(b) by 306 days.

(21) Appl. No.: 16/338,151

(22) PCT Filed: Oct. 10, 2016

(86) PCT No.: PCT/EP2016/074231
§ 371 (c)(1),
(2) Date: Mar. 29, 2019

(87) PCT Pub. No.: WO2018/068818
PCT Pub. Date: Apr. 19, 2018

(65) Prior Publication Data

US 2019/0277094 A1 Sep. 12, 2019

(51) Int. Cl.
*E21B 10/36* (2006.01)
*E21B 10/56* (2006.01)
(Continued)

(52) U.S. Cl.
CPC ..... *E21B 10/38* (2013.01); *C21B 7/12* (2013.01); *E21B 10/36* (2013.01); *E21B 10/54* (2013.01); *E21B 10/56* (2013.01)

(58) Field of Classification Search
CPC ..... E21B 10/36; E21B 10/42; E21B 10/58; C21B 7/12
See application file for complete search history.

(56) References Cited

U.S. PATENT DOCUMENTS 3,563,325 A * 2/1971 Miller ..... E21B 10/58 175/420.1
5,906,245 A * 5/1999 Tibbitts ..... E21B 10/62 175/426
(Continued)

FOREIGN PATENT DOCUMENTS

CN 1350914 A 5/2002
CN 101952540 A 1/2011
(Continued)

*Primary Examiner* — Robert E Fuller
*Assistant Examiner* — Lamia Quaim
(74) *Attorney, Agent, or Firm* — Dickinson Wright PLLC; Andrew D. Dorisio

(57) ABSTRACT

A drill bit (11) for the drilling, in particular the rotary percussive drilling, of a hole, in particular a tap hole of a melting furnace, the drill bit (11) comprising a drill head (10), which has at least one hard material insert (16), and a base body (12) for connecting the drill bit to a driving element, the hard material insert (16) being inserted into a seat, which is formed in an axial end face (13) of the drill head (10), in such a manner that at least a head cutting edge (18) of the hard material insert (16) protrudes beyond the axial end face (13), wherein the seat has a flank portion and a mating flank portion located opposite the flank portion, between which the hard material insert (16) is disposed, the flank portion, which is disposed opposite a recess formed in the hard material insert (16), being provided with a material projection (35) which is at least partially made of a welding material, is bonded to the drill head (10) via the welding material and protrudes into the recess so as to establish a form-fitting connection with the hard material insert (16).

17 Claims, 5 Drawing Sheets

(51) Int. Cl.

| | |
|---|---|
| ***E21B 10/38*** | (2006.01) |
| ***C21B 7/12*** | (2006.01) |
| ***E21B 10/54*** | (2006.01) |

(56) References Cited

U.S. PATENT DOCUMENTS

| | | | | |
|---|---|---|---|---|
| 9,133,667 | B2 * | 9/2015 | Jones | E21B 10/633 |
| 2005/0103533 | A1 | 5/2005 | Sherwood, Jr. et al. | |

FOREIGN PATENT DOCUMENTS

| | | | |
|---|---|---|---|
| JP | 5360532 | B2 | 5/2002 |
| RU | 2581059 | C1 | 4/2016 |
| WO | WO03012244 | A1 | 2/2003 |

* cited by examiner

Fig. 1
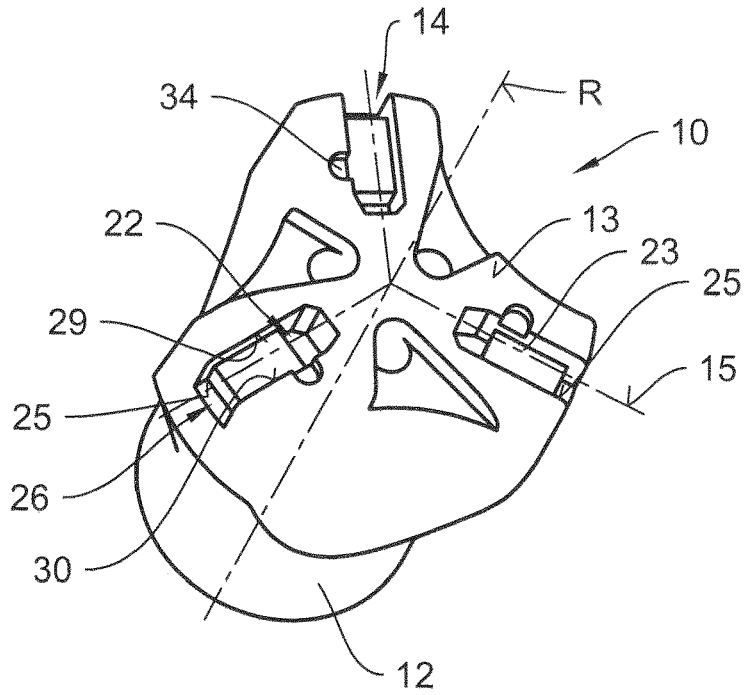
Fig. 2
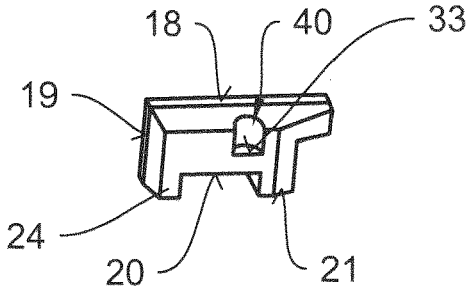
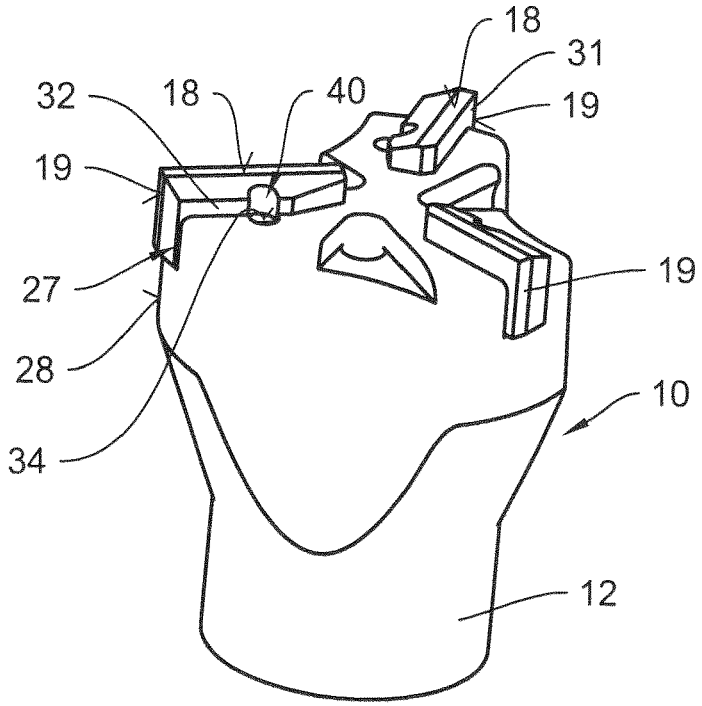
Fig. 3

Fig. 4
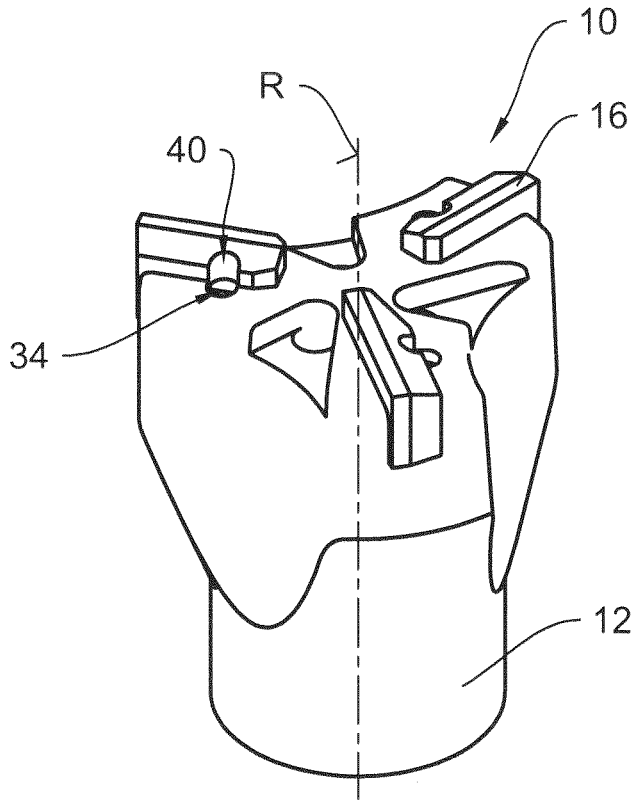
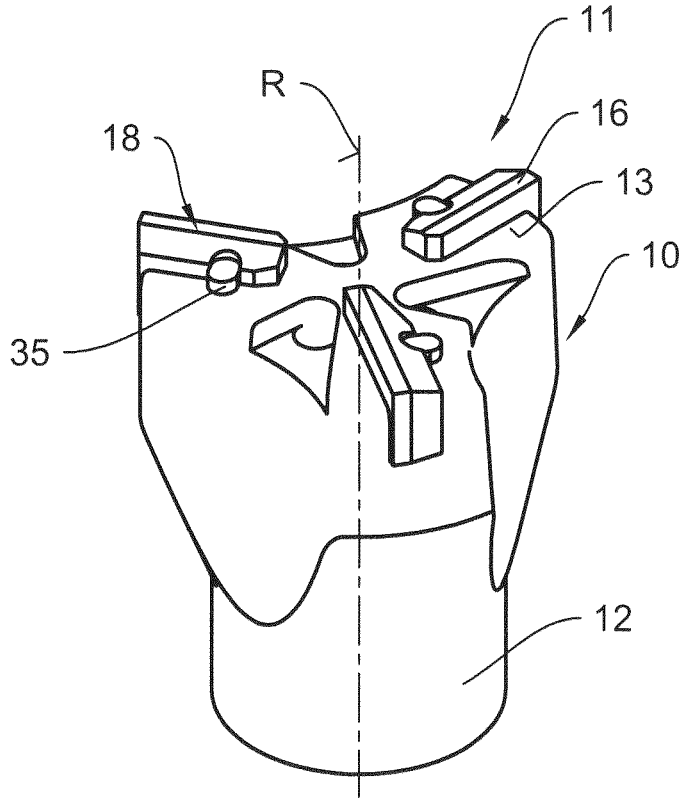
Fig. 5

Fig. 6
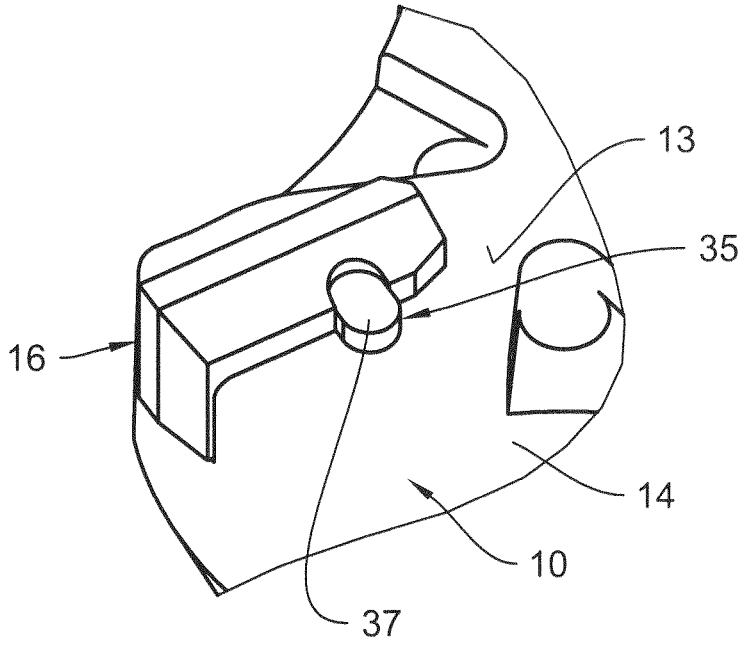
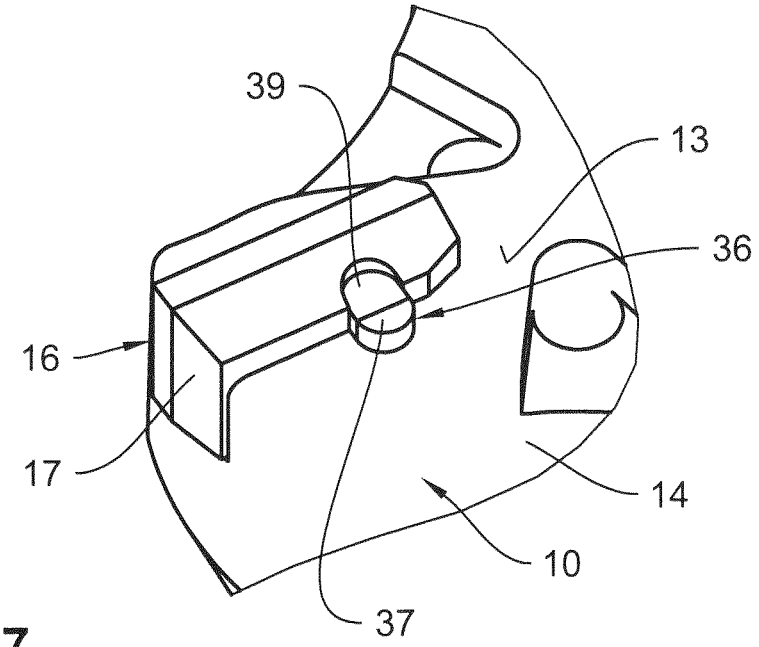
Fig. 7
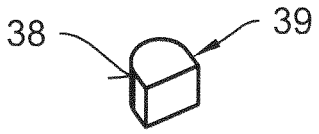
Fig. 8

DRILL BIT

FIELD OF THE INVENTION

The present invention relates to a drill bit for the drilling, in particular the rotary percussive drilling, of a hole, in particular a tap hole of a melting furnace, the drill bit having a drill head, which comprises at least one hard material insert, and a base body for connecting the drill bit to a driving element, the hard material insert being inserted into a seat, which is formed in an axial end face of the drill head, in such a manner that at least a head cutting edge of the hard material insert protrudes beyond the axial end face.

BACKGROUND OF THE INVENTION

A drill bit of the kind mentioned above is known from RU 2 581 059 C1. The known drill bit has hard metal inserts disposed on an axial end face of a drill head, said hard metal inserts being accommodated in groove-shaped clearances and each having a head cutting edge that protrudes beyond the axial end face. For fixation, the hard metal inserts are secured in the groove-shaped seats via a hard solder connection.

In order to achieve a sufficiently durable connection between the hard metal inserts and the drill head, a substantially full-surface bonding between the hard metal inserts and the seats formed in the drill head is required. The production of the hard solder connection between the drill head and the hard metal inserts requires two process steps, the drill head being heated and solder material being applied to the surface of the seat that will form the contact surface with the hard metal inserts in the first process step. Once the hard metal inserts have been inserted into the seats, the hard metal inserts are heated in the second process step so as to produce the desired soldered connection between the drill head and the hard metal inserts.

A welded connection between the hard metal inserts and the drill head, which would render the heating of the components to be connected via the soldered connection as required in order to produce a hard solder connection unnecessary, is impossible because of the relatively low temperature resistance of the hard metal inserts.

In order to be able to use a welding method to produce a connection between hard material inserts and a drill head of a drill bit despite the aforementioned poor temperature resistance of the hard material inserts, which are in particular made of hard metal, WO 03/012244 A1, for example, proposes enabling not a direct, but an indirect welded connection between the drill head of the drill bit and the hard materials inserts inserted into the seats of the drill head by providing the hard material inserts with a sleeve that accommodates the hard material inserts in a form-fitting manner prior to inserting them into the seats and by welding the sleeves to the drill head once the hard material inserts provided with the sleeves have been inserted.

While this method does allow the hard material inserts to be secured in the drill head of a drill bit through the use of a welded connection, the known method demands that an additional component be provided, which, in addition, has to be in the shape of a sleeve because of the form fit required between the additional component and the hard material inserts.

SUMMARY OF THE INVENTION

The object of the present invention is to propose a drill bit that enables a thermally resilient and easily produced mechanical connection between the hard material inserts and a drill head of the drill bit.

To attain said object, the drill bit according to the invention has the features of claim 1.

According to the invention, the flank portion disposed opposite a recess formed in the hard material insert is provided with a material projection at least partially made of a welding material, bonded to the drill head via the welding material and protruding into the recess so as to establish a form-fitting connection with the hard material insert.

Hence by means of the material projection engaging into the recess of the hard material insert, the drill bit according to the invention has an engaged connection which, in combination with the mutually opposite flank portions, definitely fixes the hard material insert in its relative position relative to the drill head, whereby a defined position of the head cutting edge, which is formed on the hard material insert, in the drill head is secured and thus the desired cutting action of the head cutting edge during drilling can be achieved reproducibly. The material projection can be designed in any given way, which means in particular that it does not have to have a shape that is adjusted to the outer shape of the hard material insert. Instead, the material projection can simply be bar-shaped or cuboid-shaped so as to enable the required engagement into the recess of the hard material insert.

The connection between the material projection, which engages form-fittingly into the hard material insert, and the drill head is configured as a bonded connection via the welding material; unlike in the case of a sleeve, whose shape has to be adjusted not only to the shape of the hard material insert in order to accommodate the hard material insert but also to the seat in the drill head, the material projection can simply be welded to the flank of the seat via a simple butt joint.

It is particularly advantageous that in order to produce a thermally and mechanically durable connection, the material projection protruding into the recess of the hard material insert can be made entirely of welding material, which means that no other material or component besides the welding material is necessary to establish the connection between the hard material insert and the drill head.

It is particularly advantageous if the material projection is a weld spot so that aside from the feeding movement of a welding head toward the welding point, no other relative movement between the welding head and the drill head is required in order to establish the welded connection.

If the weld spot at least partially fills both a clearance formed adjacent to the recess in the hard material insert and a clearance formed in the opposite flank portion of the seat, an especially durable weld spot connection can be produced.

Preferably, the length of the seat in the drill head extends substantially radially with respect to an axis of rotation of the drill head and the seat has an opening at the radially outer end, the hard material insert, whose length extends in the same radial direction, being accommodated in the seat in such a manner that the hard material insert protrudes beyond a circumferential surface of the drill head by a protrusion which extends radially with respect to the axis of rotation.

This makes it possible to design the hard material insert in such a manner that its head cutting edge extends beyond the peripheral edge of the axial end face of the drill head.

When the head cutting edge is designed to be this long in particular, it is advantageous for further stabilization of the hard material insert, which in particular counteracts the generation of vibrations of the hard material inserts, if the hard material insert is provided with a retaining extension that is substantially parallel to the axis of rotation of the drill head and that engages into a bottom clearance formed in a seat bottom of the seat.

A particularly effective configuration of the hard material insert which helps increase performance becomes possible if the radial protrusion of the hard material insert forms a circumferential cutting edge that extends substantially parallel to the axis of rotation of the drill head.

If, starting from the head cutting edge protruding beyond the axial end face of the drill head, the circumferential cutting edge extends beyond the seat bottom of the seat in such a manner that a cutting edge leg of the circumferential cutting edge is accommodated in a second bottom clearance in the seat bottom of the seat, additional support of the hard material insert in the drill head is provided, said support also counteracting the occurrence of vibrations of the hard material insert.

Preferably, multiple hard material inserts, each inserted into a seat, are distributed across the circumference of the end face of the drill head.

It is particularly preferred if the lengths of at least two hard material inserts extend differently in the radial direction with respect to the axis of rotation of the drill head in such a manner that radially inner ends of the head cutting edges have different distances from the axis of rotation of the drill head, whereby the cutting performance of the drill bit can be optimized further.

Instead of designing the drill bit with hard material inserts whose lengths extend in a defined radial direction in the drill head, the drill bit can also be designed in such a manner that the seat is cylindrical, in particular a drill hole, and the hard material insert has a retaining extension that is substantially complementary to the seat and inserted into the seat.

An operation of the drill bit independent of the rotating direction becomes possible if the hard material insert has first and second head cutting edges which are disposed parallel to each other and which extend radially to the axis of rotation of the drill bit.

If the clearance formed in the hard material insert has a flat portion adjacent to a shoulder for forming the recess and extending as far as to a head cutting edge, particularly easy accessibility of the clearance during application of the welding material for forming the material projection is ensured.

Preferably, the flat portion is disposed in a plane disposed at a right angle to the head cutting edge.

In a particularly preferred manner, the hard material insert has a radial protrusion opposite the flat portion and above the retaining extension, said protrusion extending in the direction of the head cutting edge and protruding beyond the mating flank portion, so that the length of the head cutting edge is not restricted by the flat portion.

Effective use of the axial end face of the drill head becomes possible if multiple hard material inserts, each inserted into a seat, are distributed across the end face of the drill head.

BRIEF DESCRIPTION OF THE DRAWING FIGURES

Hereinafter, a preferred embodiment of the drill bit will be explained in more detail with reference to the drawing.

FIG. 1 shows an isometric illustration of a base body of a first embodiment of a drill bit having seats for accommodating hard material inserts formed in an axial end face;

FIG. 2 shows an isometric illustration of a hard metal insert;

FIG. 3 shows an isometric illustration of a drill bit having hard material inserts inserted into the seats of the axial end face;

FIG. 4 shows the drill bit as illustrated in FIG. 3 from a different point of view;

FIG. 5 shows the hard material inserts inserted into the seats and form-fittingly secured by material projections;

FIG. 6 shows a top view of a hard material insert inserted into a seat of the axial end face of the base body with a material projection configured according to a first embodiment;

FIG. 7 is an illustration corresponding to FIG. 6, showing another embodiment of the material projection;

FIG. 8 shows a connecting piece for forming the material projection illustrated in FIG. 7;

DETAILED DESCRIPTION OF THE INVENTION

Figure 9:
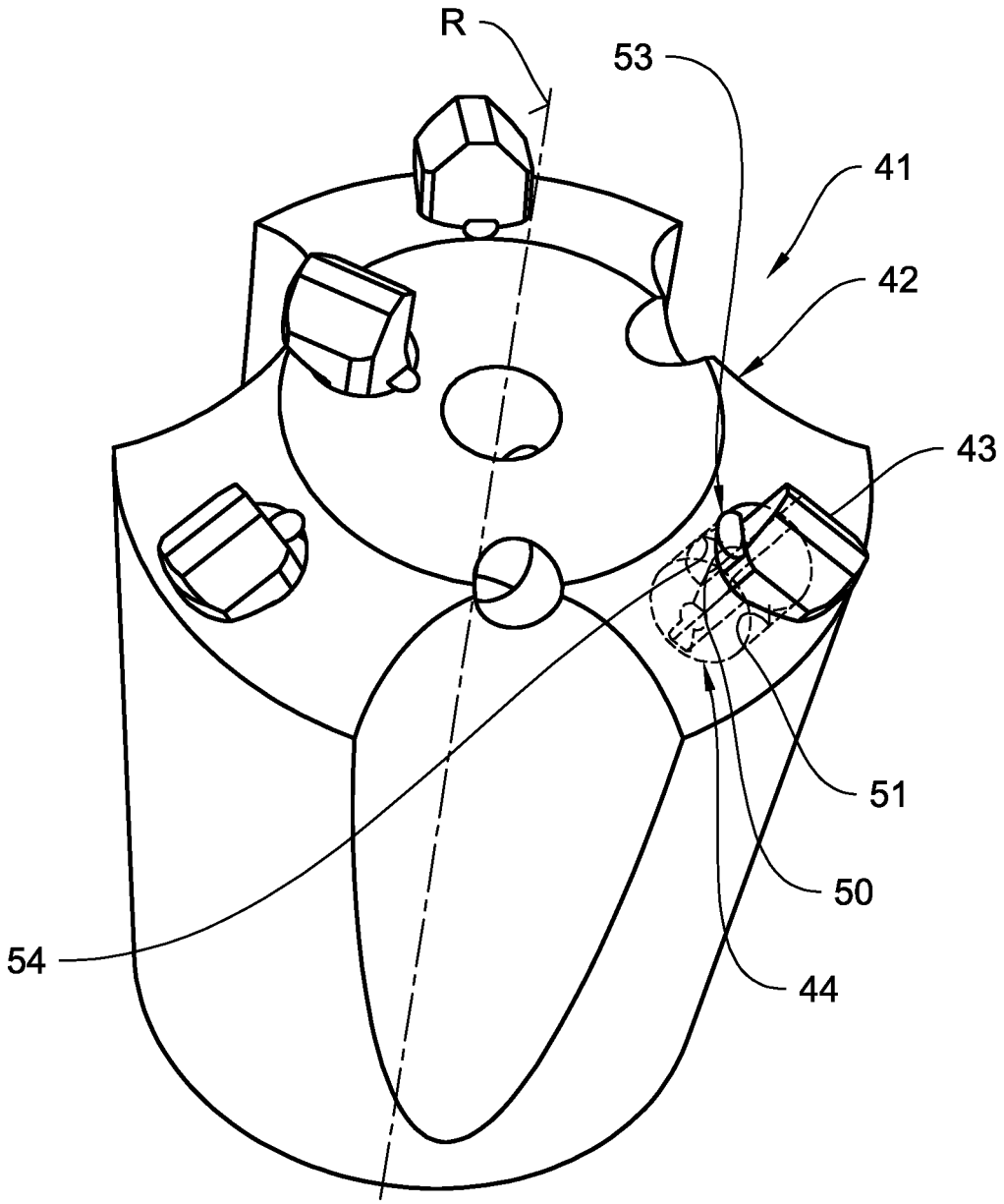
FIG. 9 shows a drill bit according to a second embodiment.

FIG. 1 shows a drill head 10 for forming a drill bit 11 as illustrated in FIG. 5. Drill head 10 has a base body 12 which, when connected to a suitable driving element (not illustrated) of a driving device, rotates about an axis of rotation R.

Base body 12 has an axial end face 13 which is provided with seats 14 which, in order to produce drill bit 11, are provided with hard material inserts 16, which can be molded bodies made of tungsten carbide, for example. When using drill bit 11 to drill a tap hole, axial end face 13, which is equipped with hard material inserts 16, is pressed against the clay blocking the tap hole in order to perform rotary drilling or rotary percussive drilling, the axis of rotation simultaneously being the axis of percussion in the latter case. In the case at hand, longitudinal axes 15 of seats 14 are each oriented radially and perpendicular to axis of rotation R.

As can be seen from a combined view of FIGS. 2 and 3 in particular, a molded body 17 of hard material insert 16 has a head cutting edge 18 at an upper longitudinal edge and a circumferential cutting edge 19 at an axial end. To produce drill bit 11 as illustrated in FIG. 5, a number of hard material inserts 16 corresponding to the number of seats 14 is inserted into seats 14 in such a manner that a retaining extension 21 formed at an underside 20 of molded body 17 extends substantially parallel to axis of rotation 12 into a bottom clearance 22 of a seat bottom 23 of seat 14.

Furthermore, molded body 17 has another protrusion at its underside 20, said protrusion being formed by a cutting edge leg 24 of circumferential cutting edge 19 and engaging into a second bottom clearance 25 of seat bottom 23, said second bottom clearance 25 being disposed in the area of an opening 26 formed at the outer radial end of seat 14, circumferential cutting edge 19 thus forming a radial protrusion that protrudes beyond a circumferential surface 28 of the base body.

As can be seen from a combined view of FIGS. 1 to 4 in particular, to produce drill bit 11 as illustrated in FIG. 5, hard material inserts 16 are inserted into seats 14 of axial end face 13 of drill head 10 in such a manner that hard material inserts 16 are accommodated between a flank portion 29 and an opposite mating flank portion 30 of seats 14, which run parallel to longitudinal axis 15 of seats 14 in the case at hand. Fronts 31 of hard material inserts 16 are disposed adjacent to flank portion 29, and backs 32 of hard material inserts 16 are disposed adjacent to mating flank portion 30.

At their backs 32, hard material inserts 16 are provided with a clearance 40 which is formed adjacent to a recess 33 and disposed opposite a clearance 34 formed in mating flank portion 30, clearances 40 and 34 being complementary in the case at hand in such a manner that clearances 40 and 34 together at least partially form a drill hole-shaped clearance which at least partially forms a receiving space for a material projection 35, as illustrated in FIG. 6, or a material projection 36, as illustrated in FIG. 7.

Based on the configuration illustrated in FIG. 4, in which hard material inserts 16 are inserted into seats 14 and clearances 40 are located in hard material inserts 16 opposite clearances 34 in mating flank portions 30 of seats 14, material projection 35 is formed in such a manner that by point-shaped deposition welding, in which welding material 37 is introduced into clearance 34 and welded to mating flank portion 30 of clearance 14, material projection 35 is formed in such a manner that it extends from clearance 34 in mating flank portion 30 as far as into clearance 40 of hard material inserts 16. Thus, a bonded connection is formed between welding material 37 and base body 14. Material projection 35, which forms from the welding material during deposition welding, engages in a form-fitting manner into clearance 40 in hard material inserts 14 without a bonded connection being established. Depending on the dimensions of welding material 37 forming material projection 35, material projection 35 can exert pressure on hard material inserts 16, which causes fronts 31 of hard material inserts 16 to come into force-fitting contact with flank portions 29 of seats 14 formed in base body 14, which allows exactly defined relative positioning of hard material inserts 16 to be realized in order to achieve a cutting edge geometry of equally exact definition on axial end face 13.

In particular if the pressure resulting from deposition welding and acting on hard material inserts 16 is supposed to be imparted on hard material inserts 16 via a surface contact as uniform as possible, it is advantageous if, like in the case of material projection 36, material projection 36 is made of welding material 37 and, additionally, a connecting piece 39 made of a weldable material engages into clearance 40 of molded body 17 in order to form a defined contact contour 38 which is adjusted to clearance 40 in molded body 17 of hard material insert 16.

Connecting piece 39 thus acts not only as a form-fitting engaging body, but also as a force-introducing element for defined transfer of the pressure generated by deposition welding to hard material inserts 16.

Figure 10:
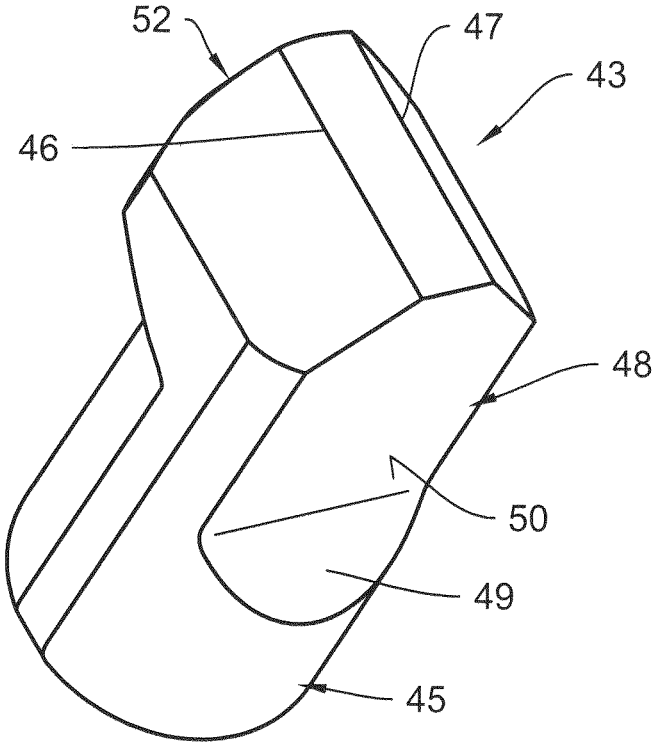
FIG. 10 shows an isolated view of a hard material insert of the drill bit illustrated in FIG. 9.

In drill bit 41 illustrated in FIG. 9, a drill head 42 is provided with hard material inserts 43 which are accommodated in cylindrical seats 44, hard material inserts 43 having a retaining extension 45 which is substantially complementary to seat 44 and inserted into seat 44. FIG. 10 shows a hard material insert 43 in an isolated view.

Hard material inserts 43 have a first head cutting edge 46 and a second head cutting edge 47 which are disposed parallel to each other and which extend radially to axis of rotation R of drill bit 41.

Clearances 48 formed in each hard material insert 43 have a flat portion 50 which is adjacent to a shoulder for forming a recess 49 and extends as far as to head cutting edges 46, 47 and is disposed in a plane disposed at a right angle to head cutting edges 46, 47. Between a flank portion 54 and flat portion 50, a material projection 53 formed by welded deposition of welding material 37 on flank portion 54 extends into clearance 48 in a form-fitting manner.

Opposite flat portion 50 and above retaining extension 45, hard material inserts 43 have a radial protrusion 52 which extends in the direction of head cutting edges 46, 47 and protruding beyond a mating flank portion 51.

The invention claimed is:

1. A drill bit (11, 41) for the drilling, in particular the rotary percussive drilling, of a hole, in particular a tap hole of a melting furnace, the drill bit (11, 41) comprising a drill head (10, 42), which has at least one hard material insert (16, 43), and a base body (12) for connecting the drill bit to a driving element, the hard material insert (16, 43) being inserted into a seat (14, 44), which is formed in an axial end face (13) of the drill head (10, 42), in such a manner that at least a head cutting edge (18, 46, 47) of the hard material insert (16, 43) protrudes beyond the axial end face (13), characterized in that the seat (14, 44) has a flank portion (29, 54) and a mating flank portion (30, 51) located opposite the flank portion, between which the hard material insert (16, 43) is disposed, the flank portion (29, 54), which is disposed opposite a recess (33, 49) formed in the hard material insert (16, 43), being provided with a material projection (35, 36, 53) which is at least partially made of a welded material (37), is bonded to the drill head (10, 42) via the welded material (37) and protrudes into the recess (33, 49) so as to establish a form-fitting connection with the hard material insert (16, 43);

wherein the hard material insert (16) has at least one retaining extension (21) which is substantially parallel to an axis of rotation R of the drill head (10) and which engages into a bottom clearance (22) formed in a seat bottom (23) of the seat (14).

2. The drill bit (11, 41) according to claim 1, characterized in that the material projection (35, 53) protruding into the recess (33, 49) of the hard material insert (16, 43) is made entirely of welded material (37).

3. The drill bit (11, 41) according to claim 2, characterized in that the material projection (35, 53) is a weld spot.

4. The drill bit (11) according to claim 2, characterized in that the material projection (35) at least partially fills both a clearance (40) formed adjacent to the recess in the hard material insert (16) and a clearance (34) formed in the opposite flank portion (29) of the seat (14).

5. The drill bit (11) according to claim 1, characterized in that the length of the seat (14) in the drill head (10) extends substantially radially with respect to an axis of rotation R of the drill head (10) and the seat (14) has an opening (26) at the radially outer end, the hard material insert (16), whose length extends in the same radial direction, being accommodated in the seat (14) in such a manner that the hard material insert (16) protrudes beyond a circumferential surface (28) of the drill head (10) by a protrusion (27) which extends radially with respect to the axis of rotation R.

6. The drill bit (11) according to claim 5, characterized in that the radial protrusion (27) of the hard material insert (16) forms a circumferential cutting edge (19) which extends substantially parallel to the axis of rotation R of the drill head (10).

7. The drill bit (11) according to claim 6, characterized in that starting from the head cutting edge (18), which protrudes beyond the axial end face (13) of the drill head (10), the circumferential cutting edge (19) extends beyond the seat bottom (23) of the seat (14) in such a manner that a cutting edge leg (24) of the circumferential cutting edge (19) is accommodated in a second bottom clearance (25) in the seat bottom (23) of the seat (14).

8. The drill bit (11) according to claim 1, characterized in that multiple hard material inserts (16), each inserted into a seat (14), are distributed across the circumference of the end face (13) of the drill head (10).

9. The drill bit (11) according to claim 8, characterized in that the lengths of at least two hard material inserts (16) extend differently in the radial direction with respect to the axis of rotation R of the drill head (10) in such a manner that radially inner ends of the head cutting edges (18) have different distances from the axis of rotation R of the drill head (10).

10. The drill bit (41) according to claim 1, characterized in that the seat (44) is cylindrical, in particular a drill hole, and the hard material insert (43) has a retaining extension (45) which is substantially complementary to the seat (44) and inserted into the seat (44).

11. The drill bit (41) according to claim 10, characterized in that the hard material insert (43) has first and second head cutting edges (46, 47) which are disposed parallel to each other and extend radially to the axis of rotation R of the drill bit (41).

12. The drill bit (41) according to claim 10, characterized in that the clearance (48) formed in the hard material insert (43) has a flat portion (50) adjacent to a shoulder for forming the recess (49), said flat portion (50) extending as far as to a head cutting edge (46, 47).

13. The drill bit (41) according to claim 12, characterized in that the flat portion (50) is disposed in a plane that is disposed at a right angle to the head cutting edge (46, 47).

14. The drill bit (41) according to claim 13, characterized in that opposite the flat portion (50) and above the retaining extension (45), the hard material insert (43) has a radial protrusion (52) which extends in the direction of the head cutting edge (46, 47) and protrudes beyond the mating flank portion (51).

15. The drill bit (41) according to claim 10, characterized in that multiple hard material inserts (16, 43), each inserted into a seat (44), are distributed across the axial end face of the drill head (42).

16. A drill bit (11, 41) for the drilling, in particular the rotary percussive drilling, of a hole, in particular a tap hole of a melting furnace, the drill bit (11, 41) comprising a drill head (10, 42), which has at least one hard material insert (16, 43), and a base body (12) for connecting the drill bit to a driving element, the hard material insert (16, 43) being inserted into a seat (14, 44), which is formed in an axial end face (13) of the drill head (10, 42), in such a manner that at least a head cutting edge (18, 46, 47) of the hard material insert (16, 43) protrudes beyond the axial end face (13), characterized in that the seat (14, 44) has a flank portion (29, 54) and a mating flank portion (30, 51) located opposite the flank portion, between which the hard material insert (16, 43) is disposed, the flank portion (29, 54), which is disposed opposite a recess (33, 49) formed in the hard material insert (16, 43), being provided with a material projection (35, 36, 53) which is at least partially made of a welded material (37), is bonded to the drill head (10, 42) via the welded material (37) and protrudes into the recess (33, 49) so as to establish a form-fitting connection with the hard material insert (16, 43);

wherein the seat (44) is cylindrical, in particular a drill hole, and the hard material insert (43) has a retaining extension (45) which is substantially complementary to the seat (44) and inserted into the seat (44);

wherein the clearance (48) formed in the hard material insert (43) has a flat portion (50) adjacent to a shoulder for forming the recess (49), said flat portion (50) extending as far as to a head cutting edge (46, 47);

wherein the flat portion (50) is disposed in a plane that is disposed at a right angle to the head cutting edge (46, 47); and wherein opposite the flat portion (50) and above the retaining extension (45), the hard material insert (43) has a radial protrusion (52) which extends in the direction of the head cutting edge (46, 47) and protrudes beyond the mating flank portion (51).

17. A drill bit (11, 41) for the drilling, in particular the rotary percussive drilling, of a hole, in particular a tap hole of a melting furnace, the drill bit (11, 41) comprising a drill head (10, 42), which has at least one hard material insert (16, 43), and a base body (12) for connecting the drill bit to a driving element, the hard material insert (16, 43) being inserted into a seat (14, 44), which is formed in an axial end face (13) of the drill head (10, 42), in such a manner that at least a head cutting edge (18, 46, 47) of the hard material insert (16, 43) protrudes beyond the axial end face (13), characterized in that the seat (14, 44) has a flank portion (29, 54) and a mating flank portion (30, 51) located opposite the flank portion, between which the hard material insert (16, 43) is disposed, the flank portion (29, 54), which is disposed opposite a recess (33, 49) formed in the hard material insert (16, 43), being provided with a material projection (35, 36, 53) which is at least partially made of a welded material (37), is bonded to the drill head (10, 42) via the welded material (37) and protrudes into the recess (33, 49) so as to establish a form-fitting connection with the hard material insert (16, 43);

wherein the length of the seat (14) in the drill head (10) extends substantially radially with respect to an axis of rotation R of the drill head (10) and the seat (14) has an opening (26) at the radially outer end, the hard material insert (16), whose length extends in the same radial direction, being accommodated in the seat (14) in such a manner that the hard material insert (16) protrudes beyond a circumferential surface (28) of the drill head (10) by a protrusion (27) which extends radially with respect to the axis of rotation R;

wherein the radial protrusion (27) of the hard material insert (16) forms a circumferential cutting edge (19) which extends substantially parallel to the axis of rotation R of the drill head (10); and wherein starting from the head cutting edge (18), which protrudes beyond the axial end face (13) of the drill head (10), the circumferential cutting edge (19) extends beyond the seat bottom (23) of the seat (14) in such a manner that a cutting edge leg (24) of the circumferential cutting edge (19) is accommodated in a second bottom clearance (25) in the seat bottom (23) of the seat (14).

* * * * *